US005944238A

United States Patent [19]

Stark

[11] Patent Number: 5,944,238

[45] Date of Patent: Aug. 31, 1999

[54] SNAP ACTION BEVERAGE CAN HOLDER

[76] Inventor: Harry Von Stark, 5 Embarcadero West 122, Oakland, Calif. 94607

[21] Appl. No.: 09/028,842

[22] Filed: Feb. 24, 1998

[51] Int. Cl.[6] ..... A45F 5/00; B65D 25/00; B65D 25/22

[52] U.S. Cl. ..... 224/148.4; 224/148.7; 220/740; 220/751; 220/287

[58] Field of Search ..... 224/148.4, 148.7; 220/740, 751, 756, 759, 287, 771; 294/32, 33; 248/311.2, 313

[56] References Cited

U.S. PATENT DOCUMENTS

| | | | |
|---|---|---|---|
| D. 273,247 | 4/1984 | Pigott | D2/400 |
| D. 291,044 | 7/1987 | Canning | D7/70 |
| 3,719,305 | 3/1973 | Pressnell | 220/740 |
| 4,088,250 | 5/1978 | Schaefer . | |
| 4,708,273 | 11/1987 | Grant | 224/148.7 |
| 4,823,975 | 4/1989 | Schwanks | 220/740 |
| 4,848,625 | 7/1989 | Lucia | 224/250 |
| 5,048,734 | 9/1991 | Long . | |
| 5,056,696 | 10/1991 | Lahr . | |
| 5,105,768 | 4/1992 | Johnson | 119/61 |
| 5,232,137 | 8/1993 | Devine . | |
| 5,261,554 | 11/1993 | Forbes | 220/412 |
| 5,361,950 | 11/1994 | Signal et al. . | |
| 5,609,277 | 3/1997 | McDonald | 224/148.3 |
| 5,695,086 | 12/1997 | Viola | 220/287 |

*Primary Examiner*—Linda J. Sholl
*Attorney, Agent, or Firm*—Harris Zimmerman

[57] ABSTRACT

A beverage can holder for attachment to a person's belt, clothing pocket or the like has an open fronted holder body with a vertically extending back portion and a horizontal base portion on which a can may be rested. A pair of resilient arms extend from the back portion to clasp the can and have spaced apart front ends forming a gap into which a can may be forced by an at least partially sidewise movement of the can. A lid attached to the holder body by a flexible lid retainer has a circular lip proportioned to snap engage on the top of a beverage can and acts to seal opened cans. In the preferred form the lid has a plurality of lips with the lips being of progressively smaller diameter and being progressively closer to the underside of the lid thereby enabling engagement of the lid on cans of differing diameter.

15 Claims, 4 Drawing Sheets

FIG. 4
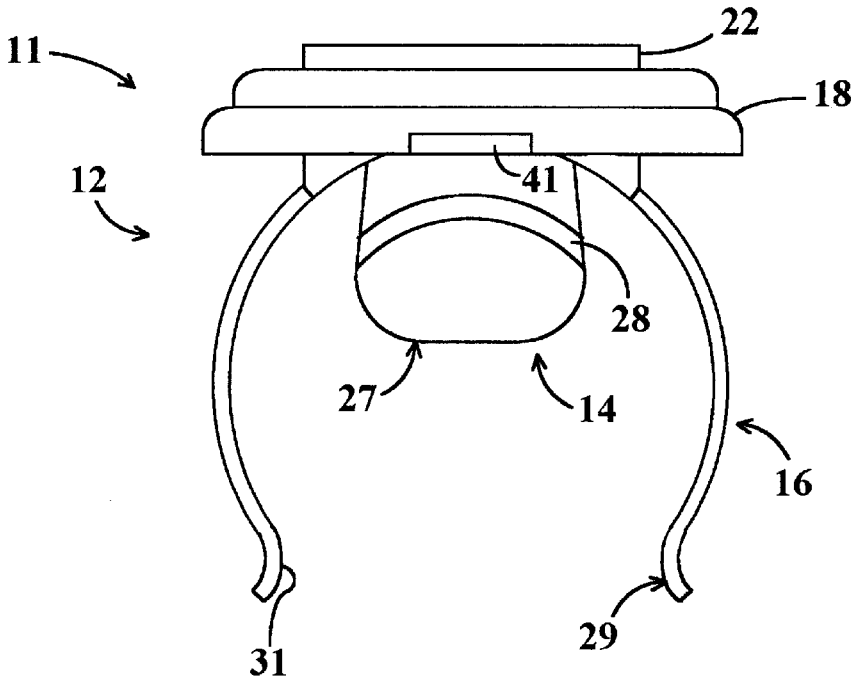
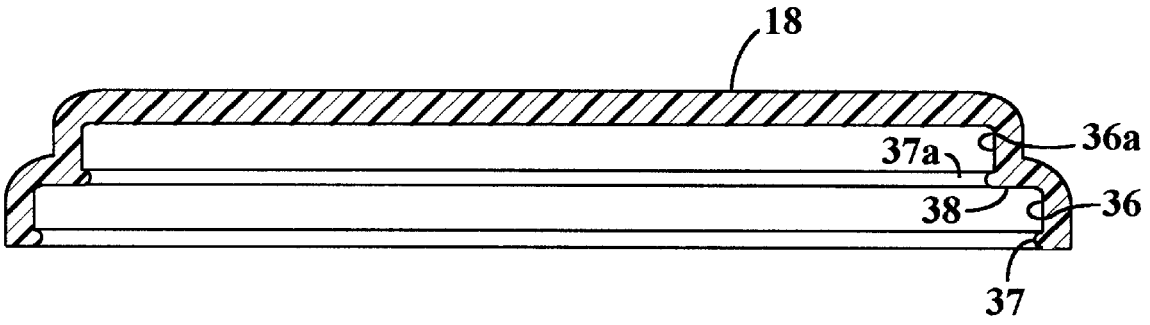
FIG. 5

FIG. 6
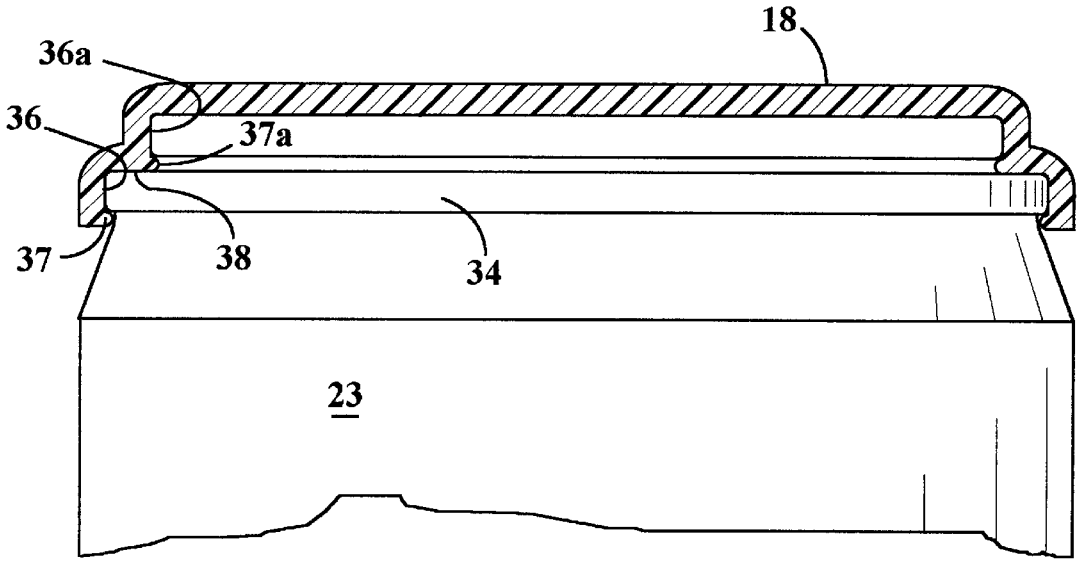
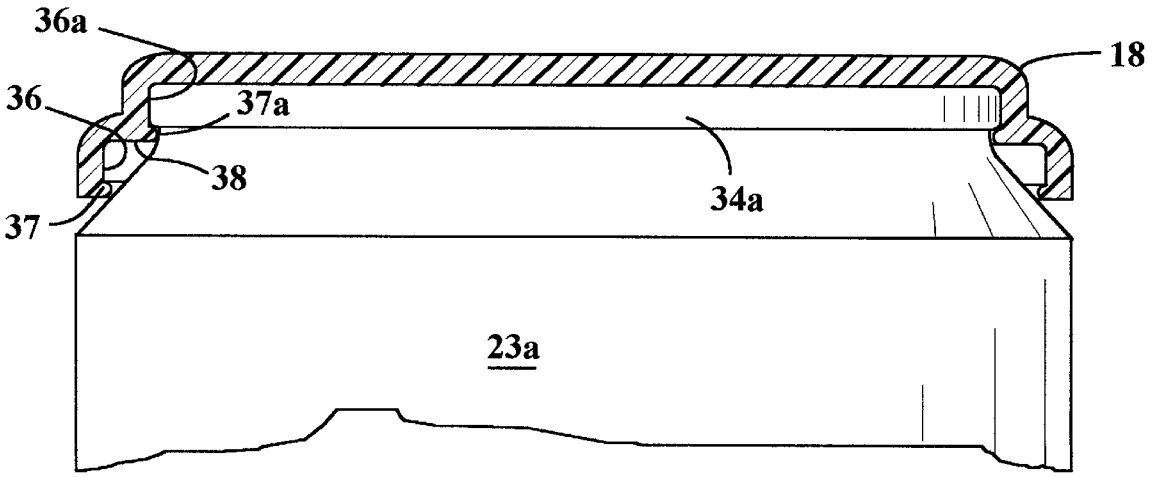
FIG. 7

SNAP ACTION BEVERAGE CAN HOLDER

TECHNICAL FIELD

This invention relates to devices for supporting and carrying a beverage can and more particularly to devices of this kind which may be clipped or otherwise attached to a person's belt, clothing pocket or the like.

BACKGROUND OF THE INVENTION

Persons often wish to carry a canned beverage for consumption at a later time. Simply carrying the can in one's hand can be inconvenient as it may interfere with other activities. Typical article carriers are not well suited for the purpose. For example, carrying a bulky can in a clothing pocket is discomforting. The person may not wish to carry a purse, backpack or the like or article carriers of this kind may be too full to accommodate a beverage can. The risk of spillage aggravates the problem if the can has been opened in order to consume a portion of the contents.

Persons who are drinking a canned beverage typically wish to put the can down at intervals rather than continuously drinking the entire contents. Finding a suitable resting place for the can is often a problem if the person is away from a table or counter top.

The prior art provides a variety of beverage can holders which clip to a person's belt. Holders of this kind as heretofore designed are not ideally suited for resolving the problems discussed above. The prior can holders typically form a cup like can receptacle with an opening at the top or a cup like framework with an opening at the top. In either case the can must be gripped at its top and then be lowered into the opening with a strictly vertical motion. Lifting of the can from the holder also requires grasping of the can at its top followed by a strictly vertical movement. Simpler hand and arm movement would be more convenient.

Some prior beverage holders of this kind have a removable lid or closure. The prior closures seal the receptacle in which the can is placed rather than directly sealing the can itself. This does not effectively prevent leakage of the contents of an opened can.

The present invention is directed to overcoming one or more of the problems discussed above.

SUMMARY OF THE INVENTION

In one aspect this invention provides a beverage can holder adapted for attachment to an article of a person's clothing. The device includes a holder body having a vertically extending back portion and an open front into which a beverage can may be entered or be withdrawn by movement of the can in an at least partially sidewise direction. The holder body further has a base portion on which a bottom of the beverage can may be rested and which extends outward from the back portion in a substantially horizontal direction. A pair of arms extend outward from the back portion of the holder body at a location which is above the base portion and spaced apart therefrom. The arms are formed of resilient material and are curved to clasp a beverage can which is rested on the base portion, the arms having front ends which are spaced apart to provide a gap therebetween through which the beverage can may be forced by an at least partially sidewise movement of the beverage can. A lid adapted for engagement on the top of the beverage can is attached to the holder body.

In another aspect of the invention, the lid has a circular lip proportioned for gripping and sealing the circular bead which is typically present at the top of a beverage can. The lid may have a plurality of such lips which are of progressively smaller diameter and which are at progressively higher locations within the lid to accommodate the lid to cans having beads of different diameters.

In another aspect of the invention, the lid is attached to the holder body by a lid retainer, at least a portion of the lid retainer being a flexible strap. In the preferred form, the lid retainer has a relatively stiff portion which extends into a slot on the holder body and which is slidable relative to the holder body, the lid retainer having a length sufficient to enable engagement of the lid on beverage cans of any of a plurality of different heights. The relatively stiff portion of the lid retainer may have protrusions at spaced apart locations along the retainer which increase resistance to travel of the lid retainer through the holder body slot when the protrusions are adjacent to the slot.

In another aspect of the invention, a beverage can holder has an open fronted holder body with a vertically extending back portion, a base portion which extends forward therefrom and a pair of beverage can engaging resilient arms which extend forward from the back portion at a location which is above the base portion and spaced apart therefrom. The arms have front ends which are spaced apart to form a gap through which a beverage can may be forced. The can holder further includes means for fastening the holder body to a person's clothing and a lid which is situated above the holder body and attached thereto. The lid has a circular lip which is proportioned to snap engage on the top of a beverage can.

A beverage can holder embodying the invention can be attached to a person's belt, clothing pocket or the like and snap engages the can to enable easy and convenient emplacement and removal of the can. The can may be emplaced and removed with a simple and comfortable motion of the person's hand during which the can is moved in an at least partially sidewise direction rather than in a strictly vertical direction. The holder has a lid which is directly engaged on the top of the beverage can. In the preferred form, the lid is configured for engagement on cans of different height and functions to seal opened cans which may have tops of different diameters.

The invention, together with further aspects and advantages thereof may be further understood by reference to the following description of the preferred embodiment and by reference to the accompanying drawings.

BRIEF DESCRIPTION OF THE DRAWINGS

FIG. 4 is a top view of the beverage can holder of FIG. 1.

FIG. 5 is a cross section view of a can sealing lid component of the beverage can holder of the preceding figures, FIG. 5 being taken along line 5—5 of FIG. 2.

FIG. 6 is a cross section view of the can sealing lid component shown in engagement with a beverage can having a first configuration.

FIG. 7 is another cross section view of the can sealing lid component shown in engagement with a beverage can having a different configuration.

DETAILED DESCRIPTION OF THE PREFERRED EMBODIMENT

Figure 1:
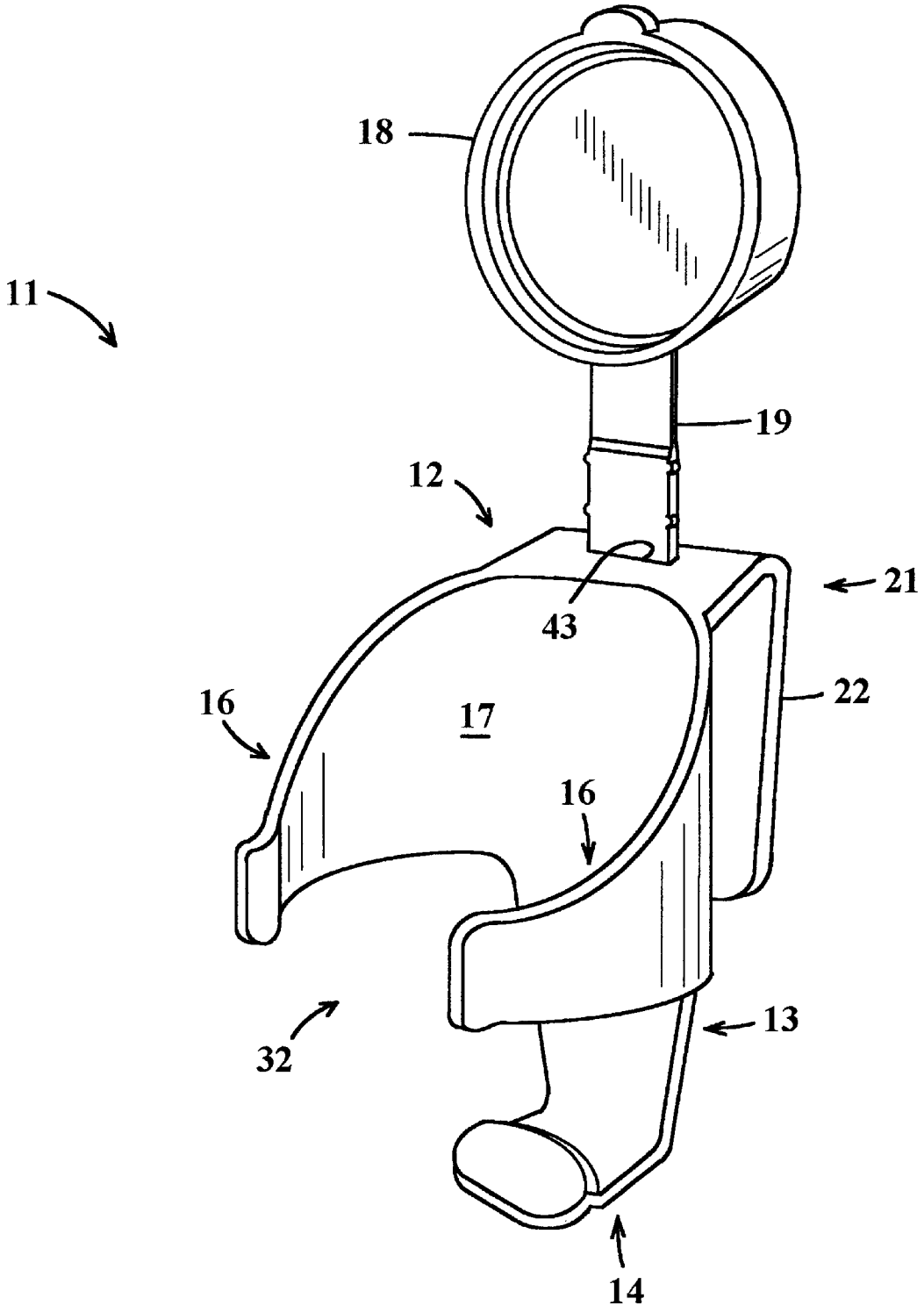
FIG. 1 is a perspective view of a beverage can holder in accordance with the preferred embodiment of the invention.

Referring initially to FIG. 1 of the drawings, a beverage can holder 11 embodying the invention has a holder body 12 with a vertically extending back portion 13, a base portion 14 which extends outward from the back portion in a substantially horizontal direction and a pair of arms 16 which extend outward from the base portion at a location which is above and spaced apart from the base portion. At least the arms 16 are formed of resilient material. In the preferred form of the invention which is shown in the drawings the back portion 13, base portion 14 and arms 16 are all portions of a single integral body 17 of material which may, as one example, be polypropylene plastic. A lid 18 for engagement on the top of a beverage can is attached to the holder body 12 by a lid retainer 19.

Means 21 for fastening the holder body 12 to a person's clothing is, in this embodiment, a belt clip 22 which extends downward from the top of the holder body behind the back portion 13 of the holder body in spaced apart relationship with the back portion. Clip 22 is preferably an integral portion of the same body 17 of material which forms the back portion 13, base portion 14 and arms 16 of the beverage can holder 11. While clip 22 is designed to be hooked onto a person's belt, it may also be clipped to the pocket of a garment or to any other support which is fittable between the clip and the back portion 13 of the holder body 12.

Figure 2:
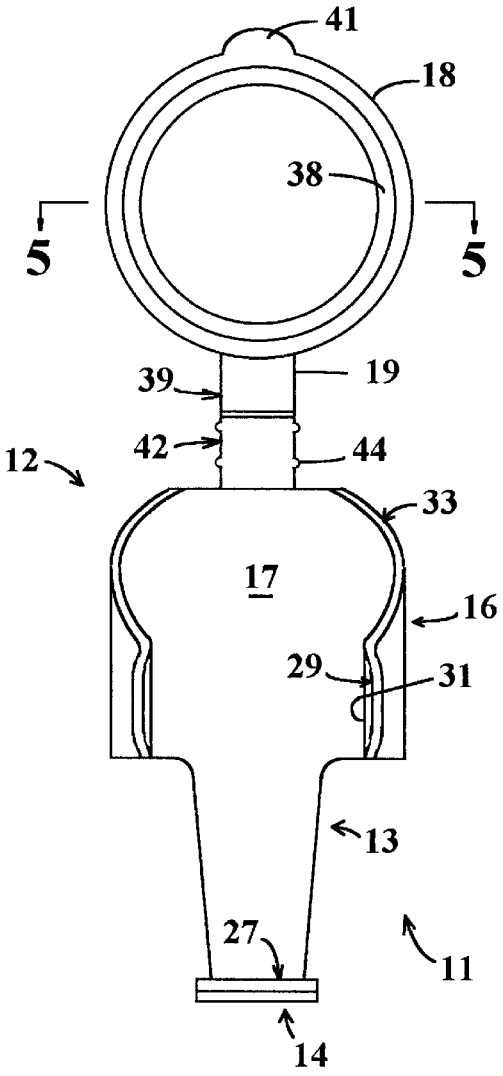
FIG. 2 is a front elevation view of the beverage can holder of FIG. 1.
Figure 3:
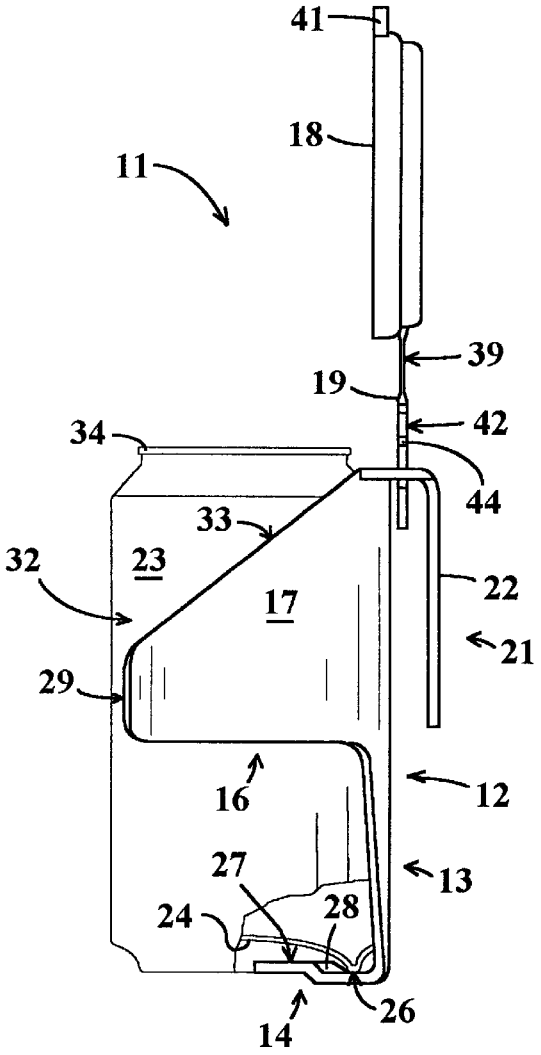
FIG. 3 is a side view of the beverage can holder of FIG. 1 shown engaging a beverage can.

Referring jointly to FIGS. 2, 3 and 4, base portion 14 of the holder body 12 forms a platform on which a portion of the bottom of a beverage can 23 can be rested. Beverage cans 23 are typically formed with a concavity 24 in the bottom of the can which is encircled by a downward projecting annular bottom bead 26. The upper surface of the base portion 14 of the holder body 12 preferably has a raised area 27 with a curved sloping edge 28 which faces the back portion 13 of the holder body 12. Edge 28 is configured and located to enable entry of the raised area 27 into the concavity 24 at the bottom of the beverage can 23. Consequently, the base portion 14 aids arms 16 in the retention and stabilizing of the can 23 in the holder 11.

Arms 16 of the holder body 12 clasp the beverage can 23 and have a curvature which conforms with curvature of the side surface of a standard beverage can. Front ends 29 of the arms 16 are spaced apart to form a gap 31 therebetween through which the can 23 may be forced by a partially or wholly sidewise movement of the can. Preferably the front ends 29 of the arms 16 are curved to diverge from each other at the open front 32 of the can holder 11 to facilitate emplacement of the can 23.

The above described configuration of the arms 16 enables a person to emplace the can 23 by a simple and comfortable sidewise movement of the can during which the can holder 11 snap engages on the can. Removal of the can 23 from the holder 11 may also be accomplished by partially or wholly sidewise movement of the can and is equally convenient.

The spacing of the arms 16 from the base portion 14 of the holder body 12 enables secure grasping of the lower portion of the can 23 by a person as the can is being emplaced in or removed from the can holder 11. The upper edges 33 of arms 16 preferably slope downward from the back portion 13 of the holder body 12 towards the front ends 29 of the arms causing a sizable portion of the top region of the emplaced can 23 to be accessible for grasping if that is necessary and for manipulation of the lid 18.

Lid 18 engages directly on the bead 34 which is typically present at the top of a beverage can 23 and functions to seal an opened can after consumption of a portion of the contents of the can. Referring jointly to FIGS. 3, 5 and 6, the lid 18 has a circular opening 36 in the underside of the lid which opening has a diameter conforming to the diameter of the top bead 34 of the can 23 and into which the bead 34 is entered. A continuous circular lip 37 extends inward for a short distance under the bead 34 to enable snap engagement of the lid 18 on the bead. The lid 18 further has an annular step 38 in opening 36 which bears against the top of the bead 34 to perform the sealing function.

Referring jointly to FIGS. 6 and 7, beverage cans 23 and **23*a* for different types of beverages may have top beads 34 and 34*a* respectively that are of different diameters. A single lid 18 may be configured to seal cans 23, 23*a* with beads 34, 34*a* of a plurality of different diameters. In the present example, the opening 36 in lid 18 has a smaller diameter region 36*a* which extends above the step 38 for a distance sufficient to admit a bead 36*a* of smaller diameter than the bead 36 which is received in the lower portion of the opening. Another circular lip 37*a*, of smaller diameter than the lower lip 37, extends inward for a short distance under the smaller diameter bead 36*a* to provide for snap engagement of the lid 18 thereon. A lid 18** of greater depth than that of the present example may be provided with additional opening regions and lips of progressively smaller diameter and which are at progressively higher locations within the lid to enable use of the lid for sealing at additional beads of still smaller diameter.

Referring jointly to FIGS. 1, 2 and 3, at least a portion of the lid retainer 19 is a strap 39 formed of flexible resilient material to enable pivoting of lid 18 into position on the can 23. A tab 41 formed on lid 18 at a location which is opposite from the lid retainer 19 facilitates disengagement of the lid from the can 23. In the preferred form of the invention another portion 42 of the lid retainer 19 is formed of thicker and therefor relatively stiffer resilient material. The relatively stiffer portion 42 extends into a slot 43 in the top of the holder body 12 and is slidable relative to the holder body. This enables the lid retainer 19 to be raised or lowered relative to the holder body 12 to enable use of the lid 18 with beverage cans 23 of differing heights. Small sidewardly extending protrusions 44 are situated at spaced apart locations along the length of the stiffer portion 42 of lid retainer 19. The small protrusions 44 are sized to increase the resistance to travel of the lid retainer 19 through slot 43 at a series of spaced apart locations along the retainer without preventing such travel if sufficient force is applied. This inhibits inadvertent detachment of the retainer 19 and lid 18 from holder body 12 while enabling the sliding movement of the retainer to accommodate to beverage cans 23 of differing heights.

While the invention has been described with reference to a single preferred embodiment for purposes of example, modifications and variations of the beverage can holder are possible and it is not intended to limit the invention except as defined in the following claims.

What is claimed is:

1. A beverage can holder adapted for attachment to an article of a person's clothing comprising:

a holder body having a vertically extending back portion and an open front into which a beverage can may be entered and be withdrawn by an at least partially sidewise movement of the beverage can, said holder body having a base portion on which a bottom of the beverage can may be rested which base portion extends outward from the back portion in a substantially horizontal direction, said holder body having a pair of arms which extend outward from the back portion at a location which is above the base portion and spaced apart therefrom, said arms being formed of resilient material and being curved to clasp a beverage can which is rested on the base portion, said arms having front ends which are spaced apart to provide a gap therebetween through which the beverage can may be forced by an at least partially sidewise movement of the beverage can further including a lid adapted for engagement on a top of the beverage can, said lid being attached to said holder body.

2. The beverage can holder of claim 1 wherein said beverage can has a circular bead at a top surface thereof and wherein said lid has a circular lip at an underside of the lid proportioned for gripping said circular bead of said beverage can.

3. The beverage can holder of claim 2 wherein said lid has a plurality of said lips which lips are of progressively smaller diameter to accommodate said lid to beverage cans which have beads of different diameters.

4. The beverage can holder of claim 1 wherein said lips of progressively smaller diameter are at progressively higher locations within said lid when said lid is positioned for emplacement on the top of a beverage can.

5. The beverage can holder of claim 1 wherein said lid is attached to said holder body by a lid retainer, at least a portion of said lid retainer being a flexible strap.

6. The beverage can holder of claim 5 wherein said lid retainer is slidable relative to said body portion of said beverage can holder and has a length sufficient to enable engagement of said lid on the tops of beverage cans of any of a plurality of different heights.

7. The beverage can holder of claim 6 wherein said lid retainer has a relatively stiffer portion which extends into a slot in said holder body and which is movable relative to said slot to change the distance between said lid and said holder body.

8. The beverage can holder of claim 7 wherein said relatively stiffer portion of said lid retainer has protrusions thereon at spaced apart locations along the lid retainer, said protrusions being proportioned to increase resistance to travel of said lid retainer through said slot of said holder body when said protrusions are adjacent to said slot.

9. The beverage can holder of claim 1 wherein said arms have ends which diverge from each other at said open front of said holder body.

10. The beverage can holder of claim 1 wherein said arms have upper edges which slope downward from said back portion of said holder body towards front ends of the arms.

11. The beverage can holder of claim 1 wherein said base portion of said holder body has an upper surface with a raised area which is spaced from said back portion of said holder body.

12. The beverage can holder of claim 11 wherein said raised area has a curved edge which faces said back portion of said holder body and wherein said raised area is proportioned to enter a concavity at the base of a beverage can.

13. The beverage can holder of claim 1 wherein said back portion and base portion and arms of said holder body are portions of an integral body of material.

14. A beverage can holder comprising:

an open fronted holder body having a vertically extending back portion and a base portion which extends forward therefrom and having a pair of beverage can engaging resilient arms which extend forward from the back portion at a location which is above said base portion and spaced apart therefrom, said arms having front ends which are spaced apart to form a gap through which a beverage can may be forced, means for fastening said holder body to a person's clothing, and a lid situated above said holder body and being attached thereto, said lid having a circular lip at an underside of the lid which lip is proportioned to snap engage on the top of a beverage can.

15. The beverage can holder of claim 14 wherein said lid has at least a pair of said circular lips at said underside of said lid and wherein said pair of lips are of differing diameters and wherein a larger diameter one of said pair of lips is situated further from said underside of said lid than the other of said pair of lips.

* * * * *